US010046570B2

(12) United States Patent
Heijnders et al.

(10) Patent No.: US 10,046,570 B2
(45) Date of Patent: Aug. 14, 2018

(54) FILTER DEVICE FOR FILTERING INK AND INK SUPPLY SYSTEM FOR PRINTING APPARATUS

(71) Applicant: Océ Holding B.V., Venlo (NL)

(72) Inventors: Ludovicus M. Heijnders, Venlo (NL); Marco T. R. Moens, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/395,186

(22) Filed: Dec. 30, 2016

(65) Prior Publication Data

US 2017/0197428 A1 Jul. 13, 2017

(30) Foreign Application Priority Data

Jan. 13, 2016 (EP) ..... 16151049

(51) Int. Cl.
*B41J 2/175* (2006.01)

(52) U.S. Cl.
CPC ..... *B41J 2/17563* (2013.01); *B41J 2/17513* (2013.01)

(58) Field of Classification Search
CPC . B41J 2/17563; B41J 2/17513; B41J 2/17593
See application file for complete search history.

(56) References Cited

U.S. PATENT DOCUMENTS 4,463,359 A * 7/1984 Ayata ..... B41J 2/04533 346/3
5,696,546 A 12/1997 Narang et al.
6,388,231 B1 * 5/2002 Andrews ..... B23K 26/0846 219/121.61

(Continued)

FOREIGN PATENT DOCUMENTS

EP 0 169 720 A2 1/1986
EP 2 216 177 A1 8/2010

(Continued)

*Primary Examiner* — John P Zimmermann
(74) *Attorney, Agent, or Firm* — Birch, Stewart, Kolasch & Birch, LLP

(57) ABSTRACT

A filter device for filtering ink for delivery to at least one drop forming unit of a print-head in a printing apparatus includes: an inlet for admission of ink to the filter device; a first filter member adjacent the inlet for filtering the ink as the ink enters the filter device; a collection chamber arranged below the first filter member for collecting the ink after the ink passes through the first filter member; and an outlet for delivering the ink from the collection chamber to a reservoir for supplying the at least one drop forming unit. The collection chamber includes at least one flow directing member defining at least one predetermined flow path, especially at least one circuitous or indirect flow path, for the ink through and/or around the collection chamber to the outlet. Furthermore, an ink supply system for supplying ink to at least one drop forming unit of a print-head in a printing apparatus includes an ink melting device for melting solid ink elements, such as toner pearls, to form liquid ink; a filter device according to the invention for filtering liquid ink from the melting device; and a reservoir for storing the liquid ink received from the filter device for delivery to the at least one drop forming unit.

17 Claims, 4 Drawing Sheets

(56) References Cited

U.S. PATENT DOCUMENTS

| | | | | |
|---|---|---|---|---|
| 6,932,462 | B2 * | 8/2005 | Watanabe | B41J 2/14209 347/65 |
| 2003/0197767 | A1 * | 10/2003 | Dudenhoefer | B41J 2/17513 347/93 |
| 2005/0243145 | A1 | 11/2005 | Essen | |
| 2006/0007281 | A1 | 1/2006 | Sonnichsen et al. | |
| 2008/0266370 | A1 | 10/2008 | Haines et al. | |
| 2011/0277303 | A1 | 11/2011 | Mallory et al. | |
| 2014/0285595 | A1 | 9/2014 | Atwood et al. | |
| 2014/0292933 | A1 | 10/2014 | Hagiwara et al. | |

FOREIGN PATENT DOCUMENTS

| | | | |
|---|---|---|---|
| EP | 2 946 932 | A1 | 11/2015 |
| WO | WO 01/03935 | A1 | 1/2001 |

* cited by examiner

FILTER DEVICE FOR FILTERING INK AND INK SUPPLY SYSTEM FOR PRINTING APPARATUS

FIELD OF THE INVENTION

The present invention relates to a filter device for filtering ink for delivery to at least one drop forming unit of a print-head in a printing apparatus and to an ink supply system including such a filter device. The invention also relates to a printing apparatus that includes such an ink filter device and/or ink supply system.

BACKGROUND OF THE INVENTION

In printing apparatuses known to the applicant, especially in printing apparatuses that employ ink of the melt type (i.e. ink which is liquid at an elevated temperature and is generated by melting solid ink elements, such as so-called toner pearls or ink pearls), solid ink pearls are melted by a melting device and fed through a filter via a collection chamber into a reservoir, from which a drop forming unit of a print-head is supplied with ink. The filter is employed to remove particles such as non-melted ink or contaminants from the liquid ink before the ink reaches the reservoir to avoid jetting instability or blockages in the drop forming unit, especially in the drop forming nozzles.

In conventional printing apparatus employing a melt-type of ink, the melting device is located fixed relative to the filter. Accordingly, the ink fed to the filter from the melting device tends to flow via the same path from the collection chamber to the reservoir, which usually is a direct path from the location where the ink enters. This has the disadvantage, however, that ink which accumulates in other areas of the collection chamber tends to remain for longer periods of time and these areas are only poorly supplied with fresh ink. This may create so-called "dead zones" within the chamber in which very little renewal of the ink takes place and the ink becomes prone to degradation. In particular, such dead zones may prevent proper operation of the ink supply system as the older ink may produce a different print quality and may also generate particles through crystallisation. The development of such dead zones can significantly shorten the lifetime of the printing apparatus.

SUMMARY OF THE INVENTION

In view of the above, an object of the present invention is to provide a new and improved filter device for filtering ink for delivery to at least one drop forming unit of a print-head in a printing apparatus, and a new and improved ink supply system in a printing apparatus.

In accordance with the present invention, a filter device for filtering ink for delivery to at least one drop forming unit of a print-head in a printing apparatus as recited in claim 1 is provided. The invention also provides an ink supply system as recited in claim 10 and a printing apparatus as recited in claim 12. Advantageous or preferred features of the invention are recited in the dependent claims.

According to one aspect, therefore, the present invention provides a filter device for filtering ink for delivery to at least one drop forming unit of a print-head in a printing apparatus. The filter device comprises an inlet for admission of ink to the filter device; a first filter member adjacent the inlet for filtering the ink as it enters the filter device; a collection chamber for collecting the ink after the ink passes through the first filter member, wherein the collection chamber is arranged below the first filter member, when the filter device is mounted in the printing apparatus; and an outlet for delivering the ink from the collection chamber to a reservoir for supplying the at least one drop forming unit. The collection chamber comprises at least one flow directing member which defines at least one predetermined flow path for flowing at least a part of the ink around the flow directing member to the outlet.

In this way, the present invention provides a filter device for the ink in which freshly melted ink entering the collection chamber necessarily follows or is compelled to follow the predetermined flow path through and/or around the collection chamber towards the outlet. As a result, from the location where the ink passes through the first filter member, the ink is directed along the predetermined flow path towards the outlet through the chamber, especially via a circuitous or indirect flow path. In other words, this filter device is able to inhibit the formation of "dead zones" in the collection chamber in which older ink accumulates and very little renewal the ink takes place. This is achieved by providing a predetermined flow path through or around the collection chamber along which mixing with the older ink may take place. Due to the predetermined flow path, the freshly melted ink should not reach the reservoir via the outlet much earlier than other ink already present in the reservoir. That is, the at least one predetermined flow path is configured to ensure that the ink flows to the reservoir more or less in the order of entry through the inlet. The invention thus contributes to maintaining full functionality of the filter device over its service life. Indeed, the service life of the filter device may be significantly extended.

It will be appreciated that the concept of the filter device according to the present invention is not limited to application in an ink supply system of a printer or to application of a melt-type of ink. Rather, the filtering device may also be employed with any other liquid supply system, and especially with any liquid which is prone to degradation and/or particle formation over time, for instance through crystallization.

In an embodiment, the collection chamber is substantially covered by the first filter member such that the ink passes or seeps downwards (when mounted in an apparatus) through the first filter member into the collection chamber. The at least one flow directing member is configured to direct the ink entering the collection chamber at any location to the outlet along the at least one predetermined flow path. Advantageously, at least some of the ink may thereby travel or flow substantially over a full length of the predetermined flow path. The flow directing element may be configured to guide the ink through areas of the collection chamber which may otherwise be prone to the formation of dead zones, thereby inhibiting their formation.

In an embodiment, the directing member(s) divides the collection chamber into at least one channel. In this way, the at least one channel defines a respective one of the at least one predetermined flow path around the flow directing member through the collection chamber to the outlet. The at least one channel may therefore be realised simply by dividing the collection chamber via the flow directing member into at least one channel in a simple to manufacture and effective manner.

In an embodiment, the at least one flow directing member comprises an elongate projection (or wall) arranged inside the collection chamber and upstanding from a base of the collection chamber. In particular, the elongate projection may be integrally formed with the collection chamber. That is, the flow directing member and the collection chamber can be formed together as a unitary part or component. For example, such a part or component could be fabricated from a polymer material and/or manufactured by means of injection moulding.

In an embodiment, the collection chamber, and especially walls of the collection chamber, may cooperate with the at least one flow directing member to form the at least one channel. In other words, the flow directing member(s) may cooperate with one or more side walls of the collection chamber to define or form the at least one predetermined flow path through and/or around the chamber, and especially through one or more turns or bends of the flow path. For example, an end of the flow directing member within the collection chamber may cooperate with one or more side walls of the chamber to form a turn or bend in the predetermined flow path. Thus, walls of the collection chamber may, at least partially, serve as walls of the at least one channel. Alternatively, the at least one flow directing member could exclusively form the at least one channel.

In an embodiment, the flow directing member is formed by an elongate projection or wall inside the chamber and upstanding from a base of the chamber, and the elongate projection or wall extends substantially parallel to the opposite side walls of the chamber. The opposite side walls may be connected to each other at ends thereof by short side walls and the elongate projection or wall terminates or ends before reaching either or both of the short side walls. In this way, the opposite side walls, the short side wall and the elongate projection may together form a turn or bend in the predetermined flow path. Other kinds and forms of turn or bend are also possible. For example, a turn or bend could be formed by two adjacent angularly arranged walls and a flow directing member positioned in the acute angle thereof. Furthermore, a curved arrangement of walls is possible.

In an embodiment, the flow directing member is connected to a side wall of the collection chamber to form a barrier. That is, the flow directing member may be connected to a side wall of the collection chamber to obstruct a direct flow path from a location of seepage of the ink to the outlet. In this way, the direct path is obstructed and the ink is directed or guided along the predetermined flow path to the outlet, thereby avoiding the formation of dead zones.

In an embodiment, the first filter member is configured to function as a pressure lock. The filter device is thereby configured so that the ink may only exit the collection chamber through the outlet if new ink seeps through the first filter member and enters the collection chamber. In other words, a small amount of ink remains in the filter, closing all pores or holes of the filter device. In this way, a desired under-pressure in the ink supply system downstream of the filter device is maintained. The pressure lock function of the filter element may be based on a capillary effect of the pores or holes of the filter device, which are wetted by the ink. In this way, an integral functionality of the first filter member, combining the function of filtering the ink on one hand, and regulating the pressure downstream of the filter device, may be realised.

In an embodiment, the pressure lock has a breaking pressure in the range of more than 1 mbar. Preferably, the breaking pressure is higher than 5 mbar and more preferably higher than 10 mbar. Such a breaking pressure may be provided by a selecting a size of the pores or holes of the first filter member adapted to the surface tension of the ink. Further, as apparent to those skilled in the art, the size of the pores or holes is selected such that particles that may form an obstruction downstream of the filter device are prevented from passing through the filter device.

According to another aspect, the invention provides an ink supply system for supplying ink to at least one drop forming unit of a print-head in a printing apparatus. The ink supply system comprises an ink melting device for melting solid ink elements, especially toner pearls, to form liquid ink and a filter device according to any one of the embodiments described above for filtering the liquid ink from the melting device. The ink supply system further comprises a reservoir for storing the liquid ink received from the filter device for delivery to the at least one drop forming unit.

As discussed above, the invention is configured to avoid formation of dead zones in the collection chamber of the filter device. As fresh ink from the melting device entering the collection chamber necessarily follows the at least one predetermined flow path, the ink can be guided along a specific, especially circuitous or indirect, path towards the outlet. In this way, full functionality of the filter device and of the ink supply system is maintained over its service life.

To feed a drop forming unit of a print-head of a printing apparatus with melted ink, solid ink elements are melted by the melting device and fed through the filter device into the reservoir, from which the drop forming unit is then supplied. By virtue of the filter device, of course, particles or other contaminants are removed from the liquid ink before the ink reaches the reservoir. In this way, blockage or jet instability in the drop forming unit, and especially in the drop forming nozzles, of the print-head are avoided.

In a preferred embodiment, the ink supply system further comprises a second filter member for filtering the liquid ink flowing from the reservoir for delivery to the at least one drop forming unit. In this way, an additional safety device in form of the second filter member is provided to remove any remaining particles from the ink.

According to a further aspect, the present invention provides a printing apparatus comprising a filter device according to any one of the embodiments described above. Alternatively or in addition, the printing apparatus comprises an ink supply system according to any one of the embodiments described above.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
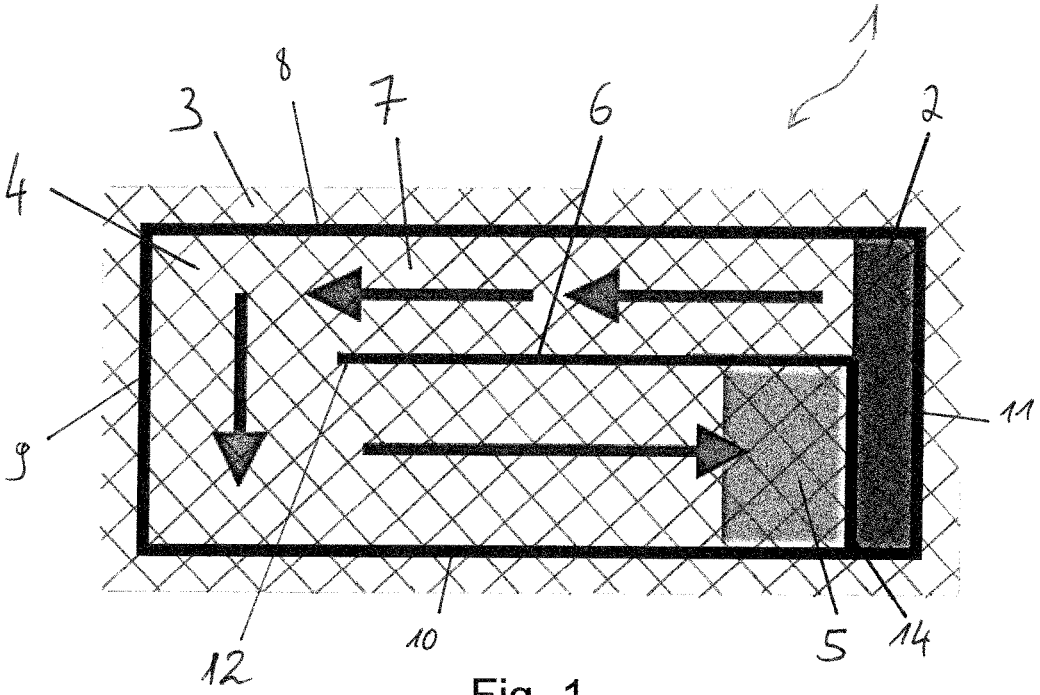
FIG. 1 is a schematic top view of a filter device for filtering ink for delivery to at least one drop forming unit of a print-head in a printing apparatus according to a preferred embodiment.

With reference firstly to FIG. 1 of the drawings, a filter device 1 for filtering ink for delivery to at least one drop forming unit of a print-head in a printing apparatus is illustrated schematically in a top view or plan view. The filter device 1 includes an inlet 2 for admission of ink to the filter device 1 and a first filter member 3 arranged adjacent the inlet 2 for filtering the ink as it enters the filter device. Furthermore, the filter device 1 comprises a collection chamber 4 arranged below the first filter member 3 for collecting the ink after it passes through the first filter member 3. The first filter member 3 essentially covers the collection chamber 4 and is symbolized by a grid delineated in FIG. 1. It will be appreciated that any kind or structure of a filter material suitable for filtering ink in a desired way may be used in the first filter member 3. For example, the first filter member 3 may comprise a pad of stainless steel fibre mesh or stainless steel "wool". The first filter member 3 may include one or more layers or components of filter material, optionally of different materials.

In this particular exemplary embodiment, the collection chamber 4 has a generally rectangular form with four side walls 8-11; namely opposite longer walls 8, 10 and opposite shorter walls 9, 11. In other embodiments, the collection chamber 4 may be formed with any shape suitable for collecting the ink after it has passed through the filter member 3. The chamber 4 is covered by the first filter member 3 so that ink passes or seeps downwards through the first filter member 3 into the collection chamber 4.

The collection chamber 4 has an outlet 5 for delivering the ink from the collection chamber 4 to a reservoir (not shown) for supplying at least one drop forming unit of a print-head (not shown). Furthermore, the collection chamber 4 includes a flow directing member 6 which defines a predetermined flow path for the ink through and around the collection chamber 4 to the outlet 5. In particular, the flow directing member 6 is provided in the form of an elongate projection or wall that divides the collection chamber 4 to form a channel 7, which in turn defines the predetermined flow path indicated by the arrows. In this way, the flow directing member 6 directs or guides the ink entering the collection chamber 4 from the inlet 2 (or indeed at any location) towards the outlet 5 along the predetermined flow path. In this example, the chamber 4 includes a single continuous and circuitous flow path as denoted by the arrows.

As is apparent from FIG. 1, a location at which the ink entering the inlet 2 seeps through the first filter member 3 is located at one end region of the chamber 4 next to or adjacent a shorter side wall 11 of the rectangular chamber. The elongate wall or projection forming the flow directing member 6 has a first free end region 12 and a second end region 14 which is connected to a longer side wall 10 of the collection chamber 4 to form a barrier and obstruct direct flow of the ink from the location of entry to the outlet 5. Accordingly, ink entering the collection chamber 4 necessarily follows the predetermined flow path and is led circuitously around and through the chamber 4.

Figure 2:
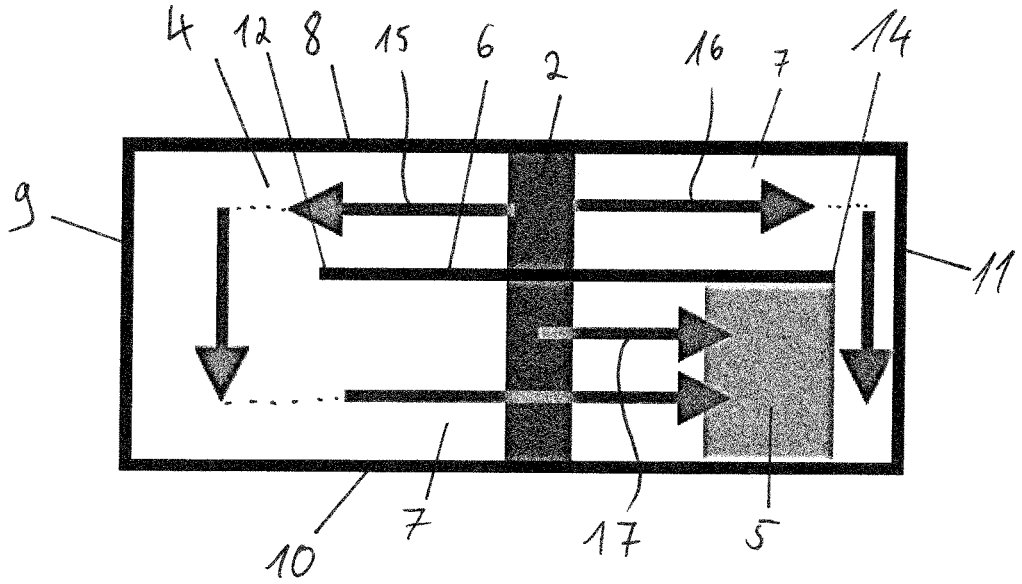
FIG. 2 is a schematic top view of a filter device for an ink supply system in a printing apparatus according to another preferred embodiment.

With reference now also to FIG. 2 of the drawings, a schematic top view of a filter device 1 according to another preferred embodiment is illustrated schematically in a top view. For a better overview, the filter member 3 has been omitted. However, the first filter member 3 covers the collection chamber 4, as was the case in FIG. 1. In contrast to the embodiment of FIG. 1, a location at which the ink from the inlet 2 may enter the collection chamber 4 through the first filter member 3 lies generally centrally across the chamber 4. In this embodiment, therefore, the flow directing member 6 divides the collection chamber into two separate channels 7 defining two separate predetermined flow paths for the ink. A portion of the incoming ink flow may thus be guided through the collection chamber 4 by the flow directing member 6 along one or other circuitous path to the outlet 5, while a second portion of the incoming ink flow may be guided more directly to the outlet 5, depending on its point of entry through the first filter member 3.

In this embodiment, both of the end regions 12, 14 of the flow directing member 6 are free standing (i.e. not connected to a side wall 8-11) within the chamber 4. In this way, the elongate wall which forms the flow directing member 6 cooperates at its first end region 12 with side walls 8, 9, 10 of the collection chamber 4 to guide or direct the flow path through a first turn or bend around the collection chamber 4, as was the case in the embodiment of FIG. 1. Similarly, the second end region 14 is free standing and cooperates with the side walls 8, 11, 10 to direct the flow path through a second turn or bend. Due to the fact that the ink from the inlet 2 may enter the collection chamber 4 centrally across the chamber 4, the two channels 7 may be considered to provide three different flow paths. A first flow path 15 directs a first portion of the incoming ink around a bend formed by the first end region 12 of the flow directing member 6 towards the outlet 5. A second flow path 16 directs the incoming ink flow around the second bend formed by second end region 14 of the flow directing member 6 towards the outlet 5. A third path 17 may notionally be considered to be the direct ink flow for the portion of the incoming ink flow entering adjacent to the outlet 5. In fact, however, the notional "third" path 17 belongs to the first flow path 15, with some of the ink merely entering that path later. In reality, the ink enters the filter device 1 in the region 2 and spreads out across an upper surface of the first filter member 3 covering the collection chamber 4. Accordingly, the ink will typically enter the collection chamber 4 distributed over the length of the predetermined flow paths 15, 16 and not at a single discrete location.

Figure 3:
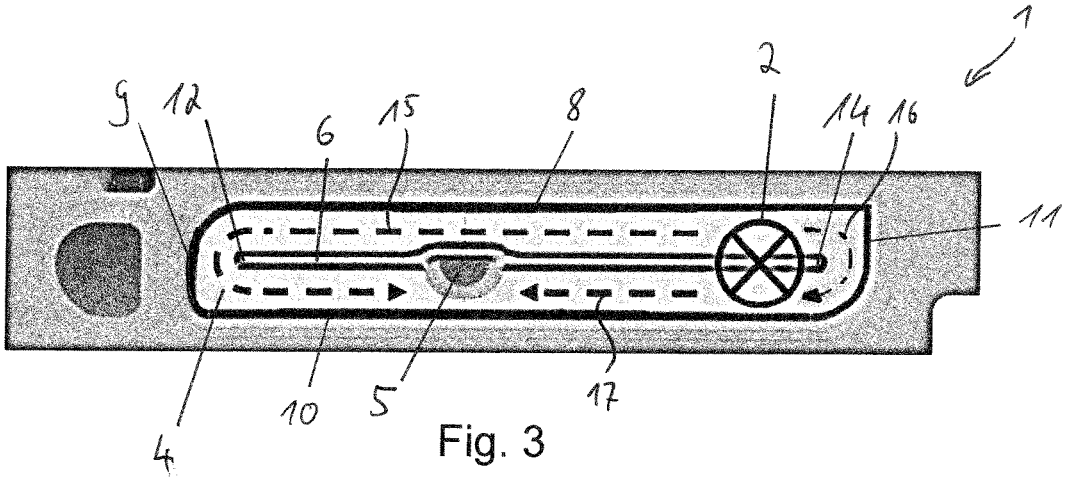
FIG. 3 is a schematic top view of a filter device for an ink supply system in a printing apparatus according to a further preferred embodiment.
Figure 4:
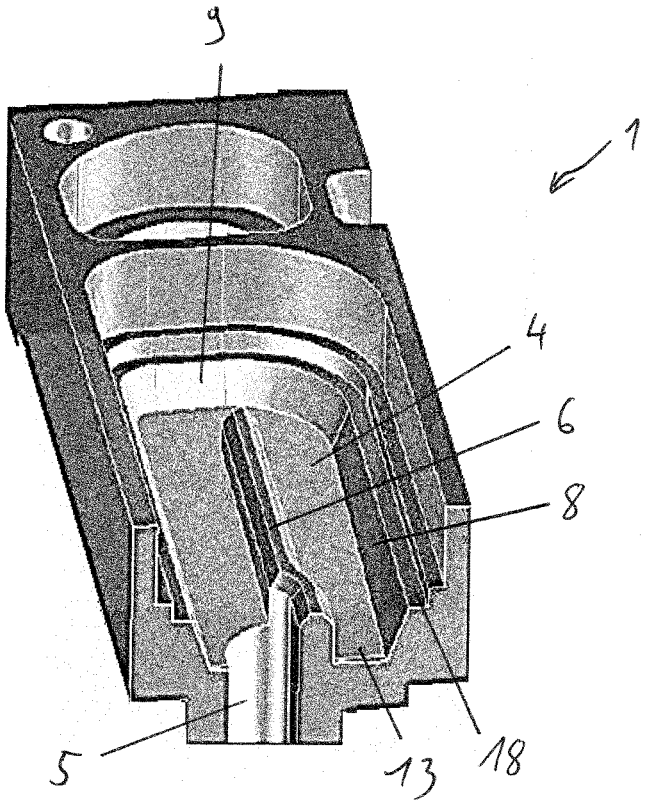
FIG. 4 is a perspective cross-sectional view of the filter device of FIG. 3.
Figure 5:
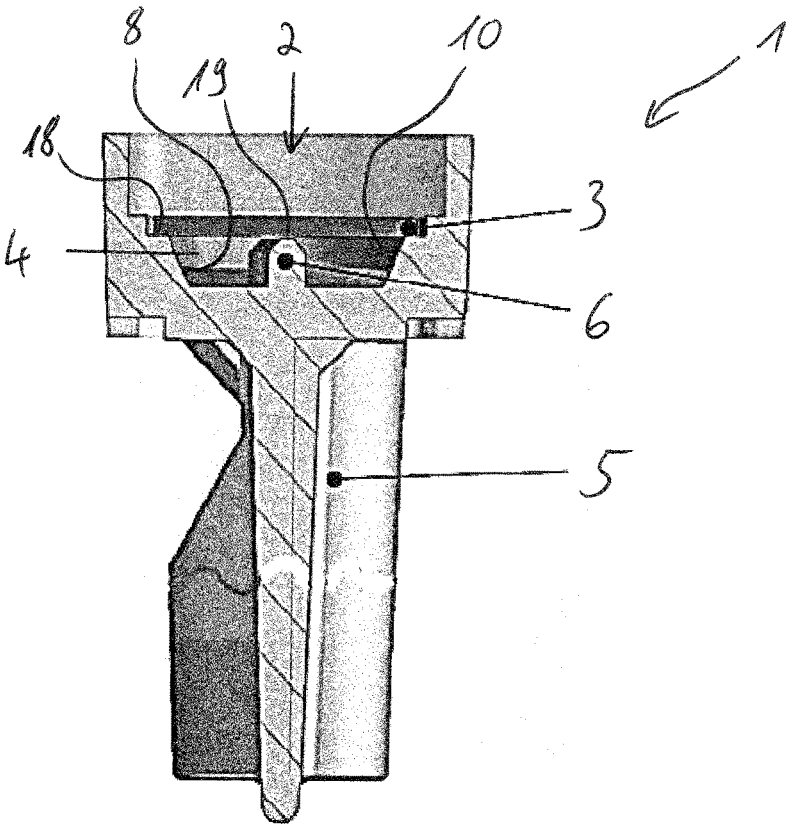
FIG. 5 is a cross-sectional view of the filter device of FIG. 3 and FIG. 4.

Referring now to drawing FIGS. 3 to 5, a filter device 1 according to yet another preferred embodiment is illustrated. Again, the first filter member 3 is omitted from plan view of FIG. 3 for clearer illustration. As can be seen in FIG. 5, however, the first filter member 3 covers the collection chamber 4, as was the case in FIG. 1. To this end, a recess 18 is provided within which the first filter member 3 may seat. According to this embodiment of FIGS. 3 to 5, the collection chamber 4 is again formed with a roughly rectangular configuration having four side walls 8, 9, 10, 11. In this case, corners of respectively adjacent side walls are somewhat rounded to enhance ink flow. The inlet 2 is symbolized by a crossed circle, indicating the position where ink enters the filter device 1, e.g. after being liquefied in a heating device or melting device (not shown). Importantly, however, (as also applies for the embodiments of FIGS. 1 and 2) entry of the ink to the collection chamber 4 will not be limited to that location, because the ink will generally spread over the whole surface of the first filter member 3 and pass through the first filter member 3 into the chamber 4 over its entire surface.

Similar to the embodiment of FIG. 2, the chamber 4 is effectively divided into two channels 7 by the elongate wall 6 projecting up from a base 13 of the chamber 4 to define two predetermined flow paths 15, 16 for the ink flow. In contrast to the embodiment of FIG. 2, however, the inlet 2 is located at a lateral end region of the collection chamber 4 near a short side wall 11 and the outlet 5 is located generally centrally. As seen in FIG. 4, the outlet 5 from the collection chamber 4 is formed as pipe or conduit extending vertically downwards from the base 13 of the chamber 4 to deliver the ink to a reservoir (not shown). As noted above, a recess 18 allows or provides for accommodation of the filter member 3 extending over the collection chamber 4 below and adjacent the side walls 8 to 11 and intersects with an upper end of the side walls 8 to 11. The first filter member 3 is shown accommodated in the recess 18 in contact with an upper ridge 19 of the upstanding wall forming the flow directing member 6. The flow directing member 6 is positioned centrally inside the collection chamber 4 and extends generally parallel to the longer side walls 8, 10 of the chamber. In this way, ink entering via the inlet 2 and seeping through the first filter member 3 in a central area may be split to follow different predetermined flow paths 15, 16 defined by the flow directing member 6.

The first filter member 3 is configured to function as a pressure lock to regulate the ink flow. This is realized in that the pores or holes of the first filter member 3 are small enough to allow a capillary effect to hold the ink in the wetted pores or holes of the filter member 3. In this way, the ink may only exit the collection chamber 4 through the outlet 5 if new ink seeps through the first filter member 3 and enters the collection chamber 4 for pressure compensation inside the chamber 4. Thus, the amount of incoming ink may be held equal to the amount of outgoing ink and the ink flow can be regulated. For example, the pressure lock may have a breaking pressure of 10 mbar, for example, or maybe even higher. This is achieved, dependent on the surface tension properties of the ink, by a predetermined maximum passable diameter of the pores or holes of the first filter member 3, for example of 10 μm, dependent on the ink supply system downstream of the filter member 3. As the size of holes or pores of the filter material is mainly relevant for the capillary effect, the total size or surface of the filter member 3 does not limit the pressure lock function. The size of the filter member 3 may be selected to provide multiple paths for the ink to avoid dead zones of the collection chamber 4. Moreover, the larger the size of the filter member 3, the more particles may be collected by the filter member 3 without completely blocking the filter member 3.

Figure 6:
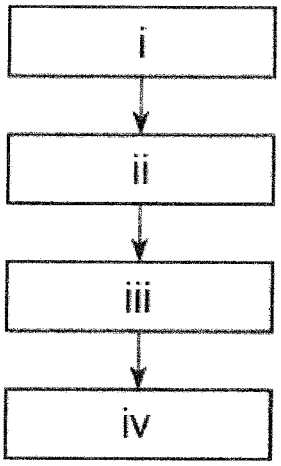
FIG. 6 is a flow diagram schematically illustrating a method of filtering ink by means of a filter device according to a preferred embodiment.

With reference to FIG. 6 of the drawings, a flow diagram schematically illustrates a method of filtering ink by means of a filter device 1 according to an embodiment. To feed ink through the filter device 1, in a first step (i), the ink is introduced via an inlet 2 to reach a first filter member 3. In a second step (ii), the ink passes or seeps through the first filter member 3 into a collection chamber 4 below the first filter member 3. In a third step (iii), the ink is directed along one or more channel 7 formed in the collection chamber 4 at least partially by a flow directing member 6 which define at least one predetermined flow path to direct the ink circuitously or indirectly through or around the chamber 4 to the outlet 5. In a fourth step (iv), the ink is discharged from the chamber 4 through the outlet 5.

Figure 7:
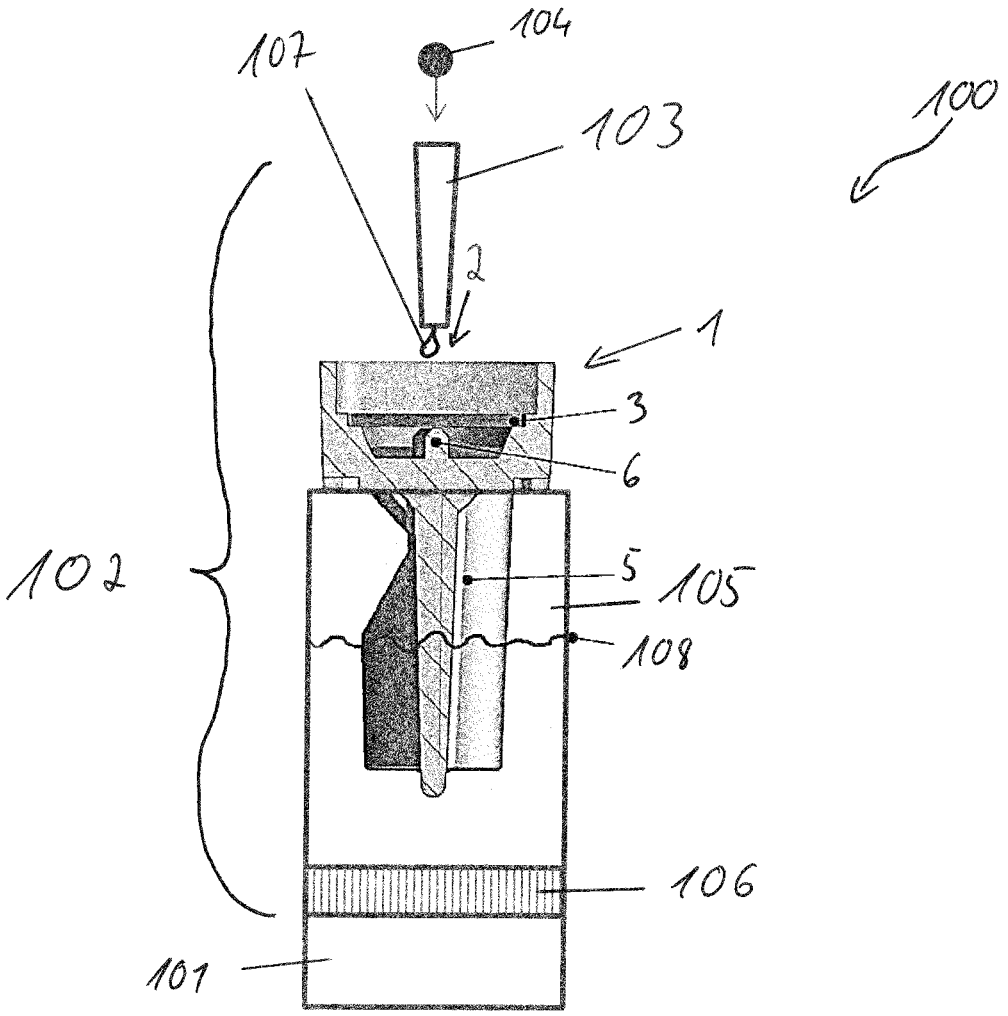
FIG. 7 is a schematic cross-sectional view of an ink supply system in a printing apparatus according to a preferred embodiment.

Finally, referring to FIG. 7 of the drawings, a schematic structure of a printing apparatus 100 is shown in a sectional view. The printing apparatus 100 comprises a print-head with a drop forming unit 101 and an ink supply system 102. The drop forming unit 101 is depicted in a symbolized manner. It comprises, for example, a plurality of drop forming nozzles for ejecting ink droplets onto a print medium (not shown). Other embodiments of the drop forming unit 101 for example comprise microelectromechanical systems (MEMS) for printing ink drops onto a substrate. The ink supply system 102 comprises an ink melting device 103, a filter device as per FIGS. 3 to 5, a reservoir 105 and a second filter member 106. The ink melting device 103 is formed as a tapered tube configured to be heated for melting solid ink elements 104. The solid ink elements 104 are fed into the melting device 103 in the form of spherical toner pearls and melted to form liquid ink 107, which is dispensed to the filter device 1 as symbolized by a droplet in the FIG. 7. The ink melting device 103 is positioned above the filter device 1, such that liquid ink 107 formed by the melting device 103 enters the filter device 1 through the inlet 2 at a predetermined location, e.g. as depicted in FIG. 3. The liquid ink 107 is then filtered by the filter device 1. A reservoir 105 is positioned below the filter device 1, such that the outlet 5 of the filter device 1 extends into and supplies or delivers the ink to the reservoir 105. The liquid ink received from the filter device 1 is stored or held in the reservoir 105 at a predetermined ink level 108 for delivery to the drop forming unit 101. A second filter member 106 is preferably arranged between the reservoir 105 and the drop forming unit 101. This second filter element 106 serves as an additional safety mechanism to prevent any possible remaining particles in the ink from reaching the drop forming unit 101.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A filter device for filtering ink for delivery to at least one drop forming unit of a print-head in a printing apparatus, the filter device comprising:

an inlet for admission of ink to the filter device;

a first filter member adjacent the inlet for filtering the ink as the ink enters the filter device;

a collection chamber for collecting the ink after the ink passes through the first filter member, wherein the collection chamber is arranged below the first filter member, when the filter device is mounted in the printing apparatus; and an outlet for delivering the ink from the collection chamber to a reservoir for supplying the at least one drop forming unit;

wherein the collection chamber comprises a plurality of side walls and at least one flow directing member which defines at least one predetermined flow path for flowing at least a part of the ink around the at least one flow directing member to the outlet, and wherein the at least one flow directing member is positioned such that at least one end of the at least one flow directing member is spaced from all side walls of the collection chamber.

2. The filter device according to claim 1, wherein the collection chamber is covered by the first filter member such that ink passes downwards through the first filter member into the collection chamber, wherein the at least one flow directing member directs the ink entering the collection chamber at any location to the outlet along the at least one predetermined flow path.

3. The filter device according to claim 1, wherein the at least one flow directing member divides the collection chamber into at least one two channels, wherein each channel defines a respective one of said at least one predetermined flow path around the at least one flow directing member to the outlet.

4. The filter device according to claim 1, wherein the at least one flow directing member cooperates with one or more side walls of the collection chamber to direct the at least one predetermined flow path around the at least one flow directing member between the one or more side walls and the at least one flow directing member.

5. The filter device according to claim 1, wherein the at least one flow directing member comprises an elongate projection arranged inside the collection chamber and upstanding from a base of the collection chamber.

6. The filter device according to claim 5, wherein an end of the elongate projection arranged within the collection chamber cooperates with one or more side walls of the collection chamber to form a turn in the predetermined flow path.

7. The filter device according to claim 1, wherein the at least one flow directing member is connected to a side wall of the collection chamber to obstruct a direct flow path from a location of seepage of the ink to the outlet.

8. The filter device according to claim 1, wherein the first filter member is configured to function as a pressure lock, such that the ink may only exit the collection chamber through the outlet if new ink seeps through the first filter member and enters the collection chamber.

9. The filter device according to claim 8, wherein the pressure lock function of the first filter member is based on a capillary effect in pores of the filter member, which are wetted by the ink.

10. An ink supply system for supplying ink to at least one drop forming unit of a print-head of a printing apparatus, the ink supply system comprising:

an ink melting device for melting solid ink elements, to form liquid ink;

the filter device according to claim 1 for filtering the liquid ink from the melting device; and a reservoir for storing the liquid ink received from the filter device for delivery to the at least one drop forming unit.

11. The ink supply system according to claim 10, further comprising a second filter member for filtering the liquid ink from the reservoir for delivery to the at least one drop forming unit.

12. A printing apparatus comprising the filter device according to claim 1.

13. The printing apparatus according to claim 12, the printing apparatus comprising an ink supply system for supplying ink to at least one drop forming unit of a print-head of a printing apparatus, the ink supply system comprising:

an ink melting device for melting solid ink elements, to form liquid ink;

the filter device according to claim 1 for filtering the liquid ink from the melting device; and a reservoir for storing the liquid ink received from the filter device for delivery to the at least one drop forming unit.

14. The filter device according to claim 1, wherein the at least one flow directing member is positioned such that the at least one predetermined flow path for flowing at least a part of the ink around the at least one flow directing member flows from a first longitudinal side of the at least one flow directing member to a second side of the at least one flow directing member opposite the first side.

15. The filter device according to claim 4, wherein the at least one flow directing member is spaced from all side walls of the collection chamber.

16. The filter device according to claim 5, wherein the elongate member extends parallel to the base.

17. The filter device according to claim 1, wherein the outlet is located downstream from the collection chamber.

* * * * *